United States Patent [19]

Dyma et al.

[11] Patent Number: 5,040,910

[45] Date of Patent: Aug. 20, 1991

[54] PRINTING DEVICE FOR THE PRODUCTION OF AUTOMATICALLY READABLE SCRIPT ON DOCUMENTS

[75] Inventors: Horst Dyma, Villingen-Schwenningen; Armin Heindke, Pfaffenweiler; Dieter Engel, Villingen-Schwenningen, all of Fed. Rep. of Germany

[73] Assignee: Mannesmann Kienzle GmbH, Fed. Rep. of Germany

[21] Appl. No.: 813,027

[22] Filed: Dec. 24, 1985

[30] Foreign Application Priority Data

Dec. 24, 1984 [DE] Fed. Rep. of Germany ..... 3447430

[51] Int. Cl.[5] ..... B41J 1/30

[52] U.S. Cl. ..... 400/144.2; 400/303

[58] Field of Search ..... 400/144.2, 144.3, 174, 400/175, 303, 306

[56] References Cited

U.S. PATENT DOCUMENTS

| | | | |
|---|---|---|---|
| 3,636,429 | 1/1972 | Jakubowski | 318/685 |
| 4,189,246 | 2/1980 | Kane | 400/144.2 |
| 4,203,675 | 5/1980 | Osmera | 400/144.2 |
| 4,236,838 | 12/1980 | Guerrini | 400/175 X |
| 4,257,711 | 3/1981 | Nakajima | 400/111 X |

OTHER PUBLICATIONS

"Step Motors–with Optimum Control", by Hans Gugg & Herbert Sax, Electronics, 1980, vol. 26, pp. 43–49.

*IBM Tech. Disc. Bulletin*, by P. J. Hurley, vol. 22, No. 4, Sep. 1979, p. 1320.

*Primary Examiner*—David A. Wiecking

*Attorney, Agent, or Firm*—Toren, McGeady & Associates

[57] ABSTRACT

In printing devices which are to print automatically readable script in particular great value is placed on an entirely accurate and clearly readable printing script because otherwise the reading devices recognize erroneous characters or the documents are rejected. In order to produce easily readable characters and in order to increase the life of the corresponding type wheels it is proposed either to move the document (8) by means of a step motor (SM) with micro-step control (MP, $D/A_1$, $D/A_2$, $V_1$, $V_2$) and to arrange the characters, which are to be arranged flush right or flush left, according to convention, in the center (FIG. 2A) and to bring about the flush right or flush left printing by means of the micro-step control. In addition, it is suggested, according to the invention, to also control spoke type wheels (1) with different pitches by means of a type wheel drive motor (M) provided with a micro-step control (MP, $D/A_1$, $D/A_2$, $V_1$, $V_2$).

4 Claims, 5 Drawing Sheets

PRINTING DEVICE FOR THE PRODUCTION OF AUTOMATICALLY READABLE SCRIPT ON DOCUMENTS

BACKGROUND OF THE INVENTION

1. Field of the Invention

The invention is directed to a printing device for the production of automatically readable script on documents by means of a spoke type wheel, a stop mechanism for the documents, and a transporting mechanism, comprising a step motor with micro-step control for the document for producing the character spacings. It is also directed to a printing device for the production of automatically readable script on documents by means of a spoke type wheel, a stop mechanism for the latter and a step motor with micro-step control for the adjustment of the spoke type wheel in the correct printing position.

2. Description of Related Art

The article by Hans Gugg and Herbert Sax: "Schrittmotoren - optimal angesteuert", ELEKTRONIK 1980, issue 26, pages 43–49, provides suggestions as to how step motors can be controlled by means of so-called micro-step control in such a way that they not only move in individual large steps, but, also, each individual step may be divided into a plurality of micro-steps, wherein it is possible to carry out the arrangement in such a way that each individual step is divided into two, four or six micro-steps. This is achieved by means of winding currents which taken an approximately sine-shaped course through the above-mentioned micro-step control, wherein it is possible, however, to keep the current in the winding in such a way that there results a corresponding stopping point for the part driven by the step motor. The step motors, which are controlled by means of a micro-step control, thus operate substantially like a standard step motor which moves its load in individual steps, the difference being that each individual step is additionally divided into a plurality of micro-steps, wherein the number of micro-steps is selectable corresponding to the design of the circuit.

According to the above article, the following description contains a proposal for a circuit for the control of a 2-page motor with continuous phase current regulation which is realized with the interface ICL 291 and the output ICL 292.

The premise for the linear modulation of the magnetic field of the step motor is the accurate control of the phase currents of its windings. FIG. 7A shows the basic circuit of a bipolar control, to which this discussion will be limited. Two modes of operation can be utilized for the depicted solution:

a) analog current sources;

b) switched current sources.

Analog solutions are sufficiently known with their advantages and disadvantages. Their application range in this mode of operation, is limited by the resulting output losses. Switching solutions are, in addition to their higher efficiency, particularly advantageous if the load is simultaneously utilizable as a storage inductance. Thus, external coils are no longer required which applies in the case of the step motor.

The integrated circuit converts the zero symmetrical input control voltage $U_{in}$ into a pulse width modulated signal by means of an internally generated triangle, which controls the output portion (FIG. 7B). In order to control the load current $I_m$, said current is converted by the resistance $R_S$ into a momentary value, which serves as negative feedback information GK.

The most important data for this integrated circuit are as follows:

supply voltage maximum 36 volts;

output current ±2 amps.;

zero symmetrical and positive control input;

transmission factor $I_{out}/U_{in}$ externally programmable;

four quadrant operation with energy feedback;

high efficiency.

The control of a 2-phase step motor according to the above-mentioned principle requires two sine functions with 90° shift. They can be produced by different circuit technology solution types: First at all by an analog sine-cosine function generator and then by a purely digital signal preparation with D/A Converters. The advantage of the last-named principle, with which the following description deals, lies, among other things, in the simple realizability of the micro-step.

FIG. 7C shows the functional mode of the D/A converter L 291. It contains five bi-directional constant current sources of a value equal to $2^0 \ldots 2^4$, said current sources being switchable by control bits. There are two additional possibilities of affecting or modulating these current sources:

1. Their common current direction is to be fixed through the logic input SIGN.

2. The magnitude of the input current DACIN determines its absolute value.

The resulting current thus produced can be tapped at the output DACOUT—with the internal operational amplifier $V_1$ it is converted into an equivalent voltage, which is compatible to the output current source as far as level is concerned. The current as well as the voltage output are 0-symmetrical, meaning they can be of positive or negative magnitude.

The signal generation with hardwired logic is indeed a basic possibility, but is, however, mostly rejected because of the high cost and the insufficient flexibility. In today's state of the art, the microcomputer is the most sensible device for this purpose. With this help, the required signal shape sequences can be turned by means of software optimally onto the step motor system.

The interaction of the individual components is discernible from FIG. 7D. This Figure also contains a detailed resolution of the block diagram of the output current sources L 292. By means of the regulator R, which acts on both D/A converters, the output amplitude and thus, the peak current of the step motor phases is adjusted to the motor type utilized. The dimensioning of the external negative feedback network of the output current source L 292 has an influence on the step function of the output current—it must therefore be individual adapted to the motor impedance. If one now connects the comparator inputs (terminal 4) of the end steps, whereby an oscillator network can be eliminated, then both of them work with the same timing frequency. For a control output of 60 watts per step motor phase, the space requirement of the overall structure of the end step is very small comprising 63 $cm^2$.

In step motors the influencing of the effective levels of the phase current as a function of the momentary operational situation is often desirable.

In order to achieve short acceleration and braking times, a high torque is required. This, however, can only be achieved by high phase currents, which simultaneously drive up the motor performance losses and thus, the temperature. Therefore, one must, in case one does not change the current, find a compromise between torque and motor heating. Higher phase currents are allowable for short periods (they are limited by winding current density and danger of demagnetization of the rotor), if, for the remaining time in which the motor is inoperative, the current is reduced. The positioning effect diminishes proportionally to the current, which, however, is only of importance if, in addition to the mass inertia of the load, high frictional forces are present. If the possibility exists to influence the effective motor current in addition to the control timing, then one achieves shorter acceleration and braking times with simultaneously improved efficiency of the overall system.

The variation of the effective motor current is possible in a simple manner in the circuit concept in FIG. 7D, by the D/A converter L 291, the output signal amplitude can be varied by the magnitude of a current flowing into the terminal 9.

FIG. 7E, shows a solution with a logic controllable operational amplifier configuration which is not used here (V21) which is additionally located on the chip. The amplifiers of the two integrated circuits are switched through a resistance matrix as 2-bit-D/A converters, which can adjust the motor effective current through a microcomputer in four stages (FIG. 7F).

In order to achieve a constant angular velocity in the range of low step frequencies within a full step, the digitally produced control curve must have as fine as resolution as possible. This means that the timing frequency is n-times higher compared to the full step frequency. The sensible limits of the resolution of the motor current are set by the integration behavior of the inductance. If this high resolution remains further present during increase of the step frequency, the experience has shown the output speed of the microcomputer limits the step frequency of the motor, which would still maintain its functioning ability with considerably higher time rates.

As already previously stated, the control curve shape increasingly loses its significance with increasing rpm, this is because of the current integration of the motor. A coarsening of the quantification therefore does not have disadvantageous effects at higher rpm's and, is thus, a legitimate means to increase the upper limit frequency of the system up to 2n-times. The timing situation occurring thereupon is comparable with the conventional rectangular control.

It is a particularity that the microcomputer can stop the rotor of the step motor in any position within a full step. The accuracy of the intermediate positioning is determined by the linearity of the magnetic field of the motor, its retention movement and the quantification factor of the current. A half step - or quarter step positioning is realizable without difficulty in most cases without these limiting factors. This fact opens the possibility to utilize coarse step motors in systems, in which a micro-step angle is required. Herein two advantages result:

1. With a constant timing rate situation, the speed of the motor increases, because it covers a larger angle of rotation per step.

2. The cost of these motors is mostly lower compared to those having higher resolution, wherein the overall costs can be reduced.

The possibility of even higher angular resolutions beneath the quarter step exists if angle encoders are used, by means of which a positioning error can be corrected through a regulation loop.

Preparation of the sine-wave current curve, reduction of the current resolution as a function of speed, micro-step positioning, and phase current control depending on acceleration are tasks and problems which are to be solved by the microcomputer.

When printing automatically readable documents, there are sometimes problems with script as, e.g. the so-called E 13B, because in this case, according to convention, the characters are to be printed in the print area provided for them, not in the center, but, rather, flush right, for example. When this kind of script is arranged on the individual spokes of a spoke type wheel then, during standard use of a step motor, there follows the inevitable consequence that the characters must also be arranged on the spokes so as to be off-centered in order to arrive in the correct position when printing. As a result of this arrangement, the spokes which carry this type twist during printing because of the characters which are arranged to one side. As such, a premature breakage of the corresponding type spoke cannot be ruled out. Moreover, in such an arrangement of the type to one side of the spoke, for example, the type 1, a clean printing of the type can not be ensured to the same extent as when the type is symmetrical, as, for example, the type of the numeral 8.

SUMMARY OF THE INVENTION

It is the object of the invention, therefore, to improve the life and the quality of the printing of type, particularly type to be printed asymmetrically.

Moreover, the invention also has the object of improving a spoke type carrier in such a way that different type with various dimensionings can also be used for printing with the same control means.

In order to meet the proposed object, the known printing device is characterized in that the asymmetric characters to be printed, according to convention, flush left or flush right, respectively, in a defined field are also arranged centrally on the spokes of the printing type wheel, and in that the document is moved, by means of the step motor forming the transporting means, in micro-steps by different character spacings in such a way that a flush left or flush right printing, respectively, is effected despite the central arrangement of the type on the spokes.

In arrangements in which the step motor of the spoke type wheel is equipped with micro-step control, the invention is characterized in that the pitch of the type wheel is irregular, wherein the micro-step control effects the correct adjustment of the type wheel into the proper printing position.

. The invention is now described in more detail by means of the attached drawings.

DESCRIPTION OF THE PREFERRED EMBODIMENT

Figure 1:
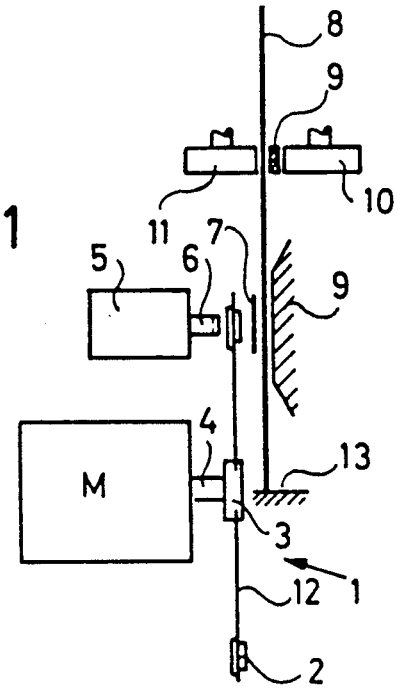
FIG. 1 is a diagrammatic drawing of the printing device, according to the invention.

As shown by FIG. 1, the printing device, according to the invention, consists of a spoke type wheel 1 which carries individual type heads 2 at the ends of its spokes 12. The spoke type wheel 1 is fastened by means of its hub 3 to an axle 4 which is driven by a motor M. This motor M is a step motor. The type heads 2 are fired, by means of a drive magnet 5 and a corresponding stop hammer 6, against a color ribbon 7 and a document 8 accompanied by bending of the respective spokes 12, wherein the type heads 2 are pressed against a printing base 9. The document 8 rests on a stop 13.

Figure 4:
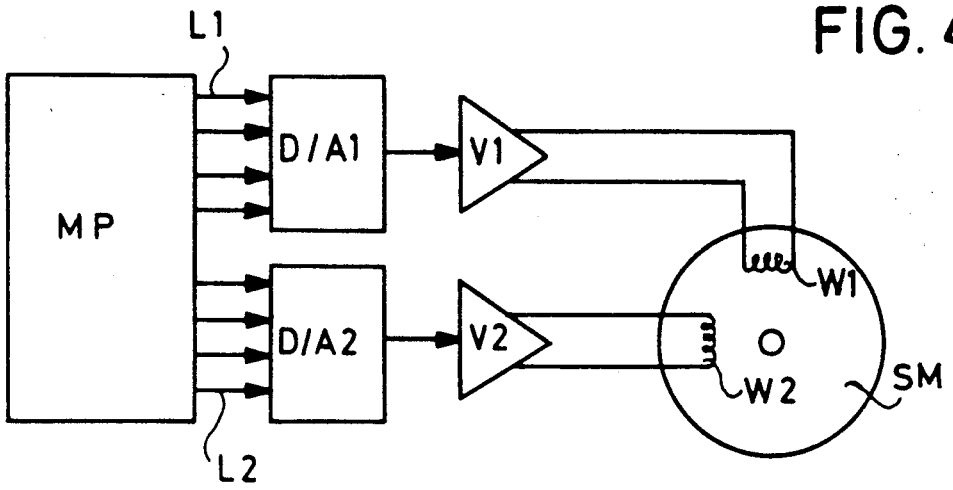
FIG. 4 shows the control device for the step motor.

The document 8 is driven by means of a transporting belt 9 which is driven by another step motor SM (FIG. 4). The feed rollers 10 and 11 act on the belt 9 on the one hand and on the document 8 on the other, and ensure that the document 8 is held between the rollers 11 and the transporting belt 9. As soon as one of the feed rollers 10 or 11 is swiveled away, the document 8 is no longer transported, i.e. released for removal or delivery to another transporting means.

It should be noted here that the motor M, which produces the rotational movement for the spoke type wheel 1, as well as the motor SM, which effects the transporting movement of the document 8 via the belt 9, are step motors. One or both motors are equipped with a microstep control according to FIG. 4. The step motor to which the micro-step control is connected (the rotational motor M, according to FIG. 1, or the transporting motor SM, according to FIG. 2) depends on the construction of the spoke type wheel, as described in more detail in the following.

Figure 6:
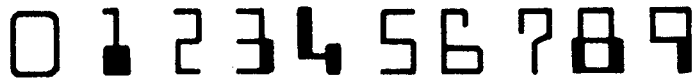
FIG. 6 shows the script with asymmetrical type arrangements.
Figure 7A:
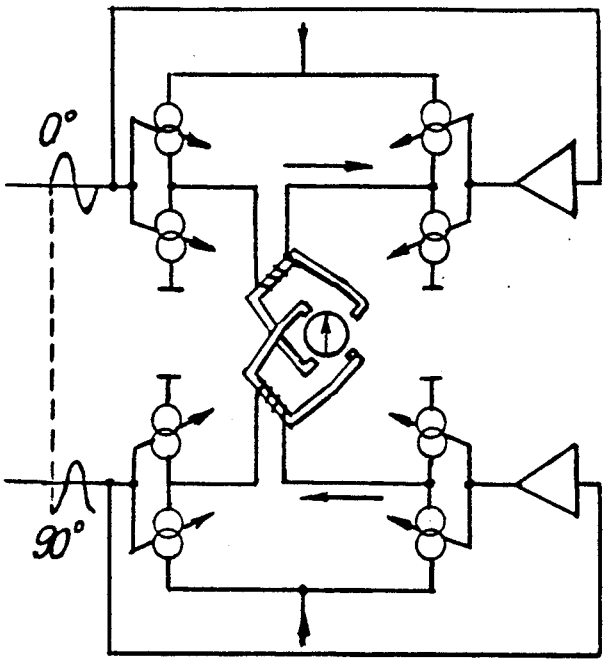
FIGS. 7A to 7F show conventional aspects of steps motor control.
Figure 7B:
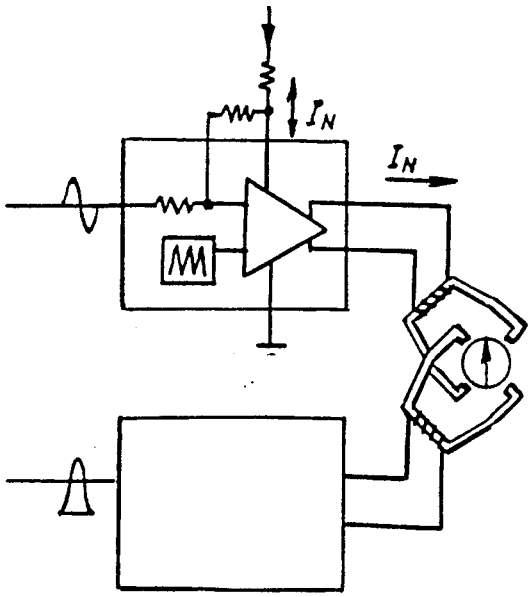
Figure 7C:
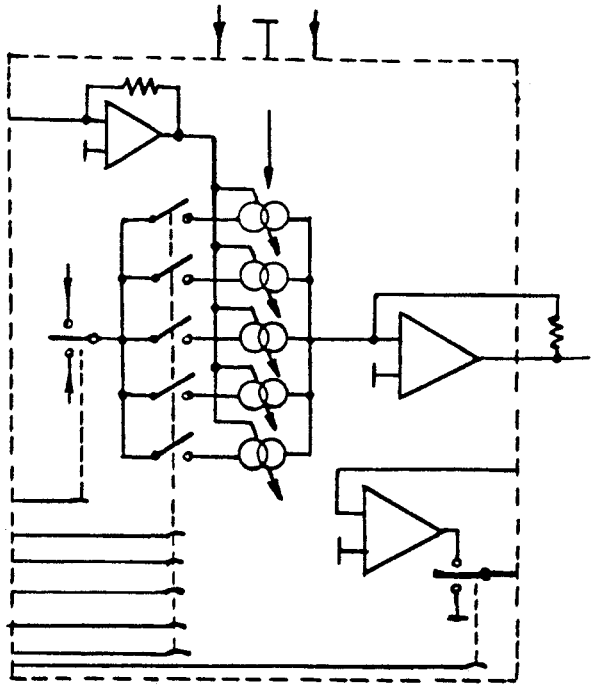
Figure 7E:
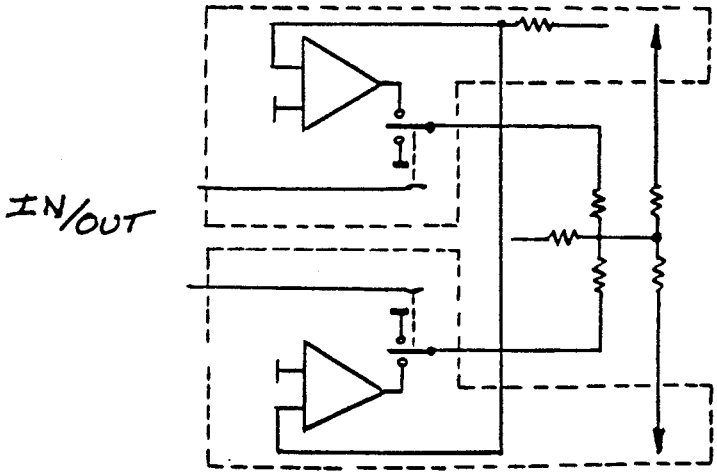
Figure 7F:
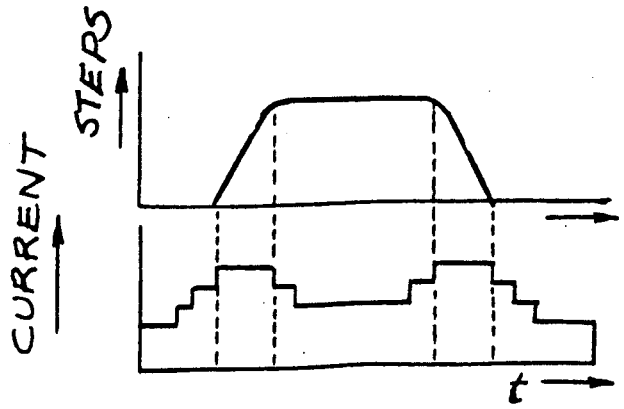
Figure 7D:
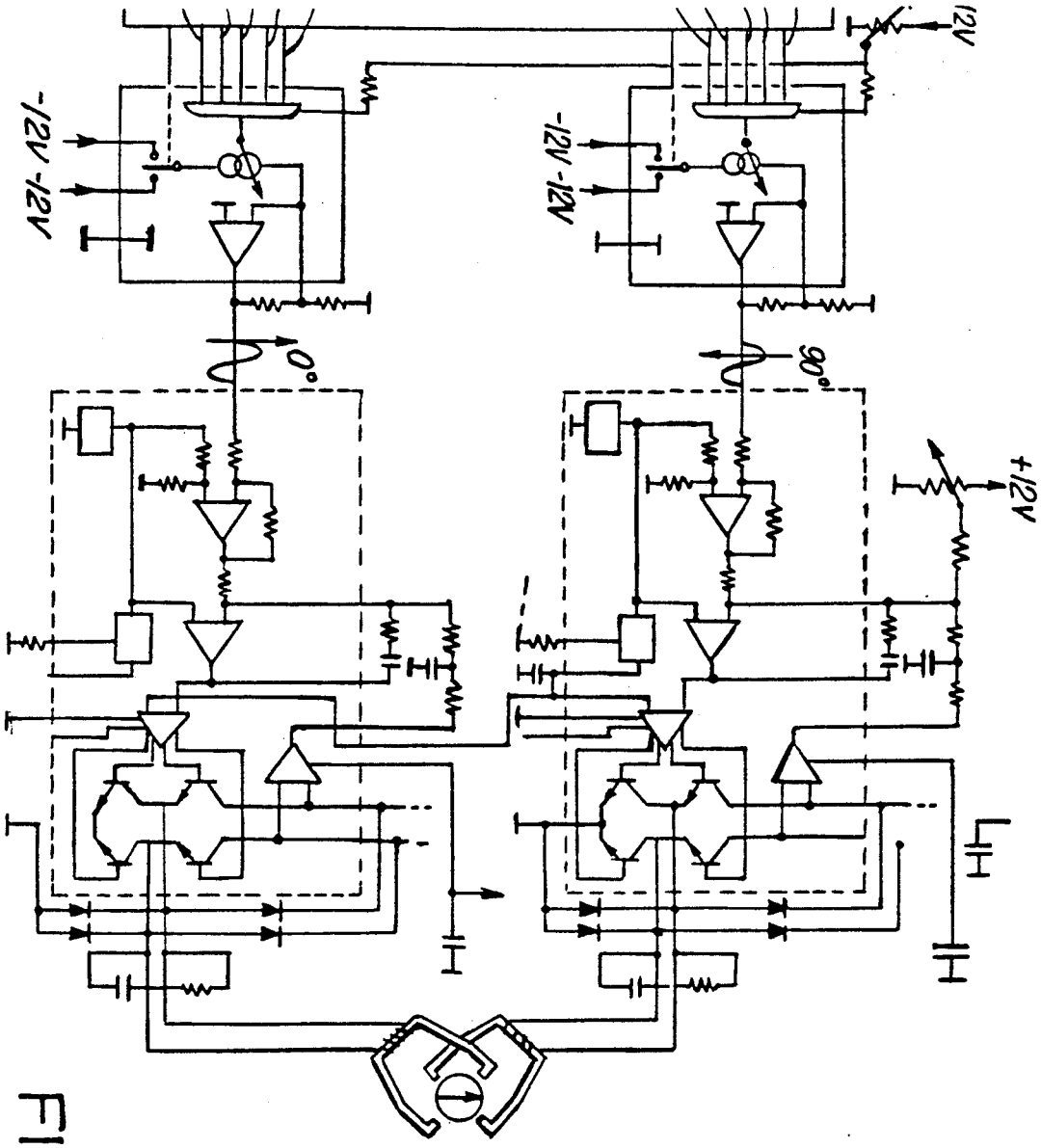

In the known prior art, for example, in the E13B coding script, the type "1" and "5" are arranged on the left side of the type head 2, as follows from FIGS. 2D and 2E, so that the type can be printed flush right in the corresponding printing place during printing. A print sample of the E13B script is shown in FIG. 6. FIG. 2C shows how the type head 2 of one these spokes 12 is constructed. On the front is the type 14, on the back is a directing projection 15. The projection 15 cooperates with the stop hammer 6. For this purpose the stop hammer 6 is provided with a corresponding aligning recess 16. During the swinging of a spoke 12 according to FIGS. 2D and 2E, it is obvious that the left side of the type head 2, rather than the right side, impacts on the document 8, thereby resulting in a twisting of the spoke 12, which disadvantageously affects the life of this spoke 12. In addition to this, the printing is qualitatively bad in this case because the right side of the type head 2 is moved further by the hammer 6, while the left side has already found its stop at the document 8. Therefore, it cannot be avoided that the left side of the type is not printed as cleanly under certain circumstances as would be required for a perfect reading of the documents, and rejections of the documents occur more frequently.

Figure 2A:
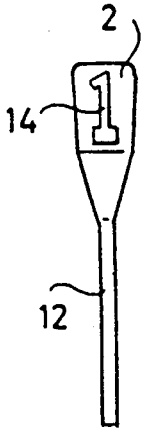
FIGS. 2A to 2E show different spoke arrangements.
Figure 2B:
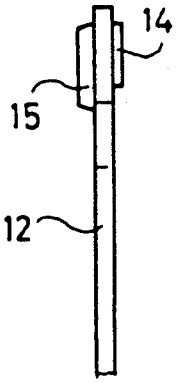
Figure 2C:
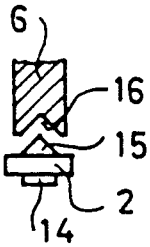
FIG. 2C PRIOR ART
Figure 2D:
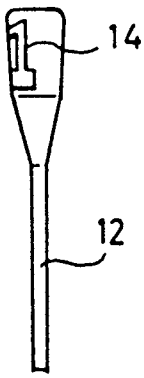
FIG. 2D PRIOR ART
Figure 2E:
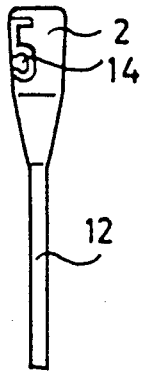

In order to avoid this, according to the invention, all type, including the asymmetrical type, is arranged centrally on the type head, as shown in FIG. 2A. In this way, the twisting of the spoke 12 is avoided and a clean printing is simultaneously ensured.

However, in order to achieve a flush right printing of the character despite the central arrangement of the type on the type head 2, so that the character can be correctly recognized by a reading device, the micro-step control, according to FIG. 4, is provided as described above. The motor SM has two windings $W_1$ and $W_2$ which have current, in a sine-shaped manner, in the corresponding phase angle in order to achieve the transporting step. It is a matter of choice whether this involves the windings $W_1$, $W_2$ of the motor SM, which effects the transporting control, or the motor M, which effects the rotation of the type carrier. The motor which is to effect the correct positioning of the type 2 and the document 8 relative to one another is, in any case, equipped with the micro-step control according to FIG. 4.

Figure 5:
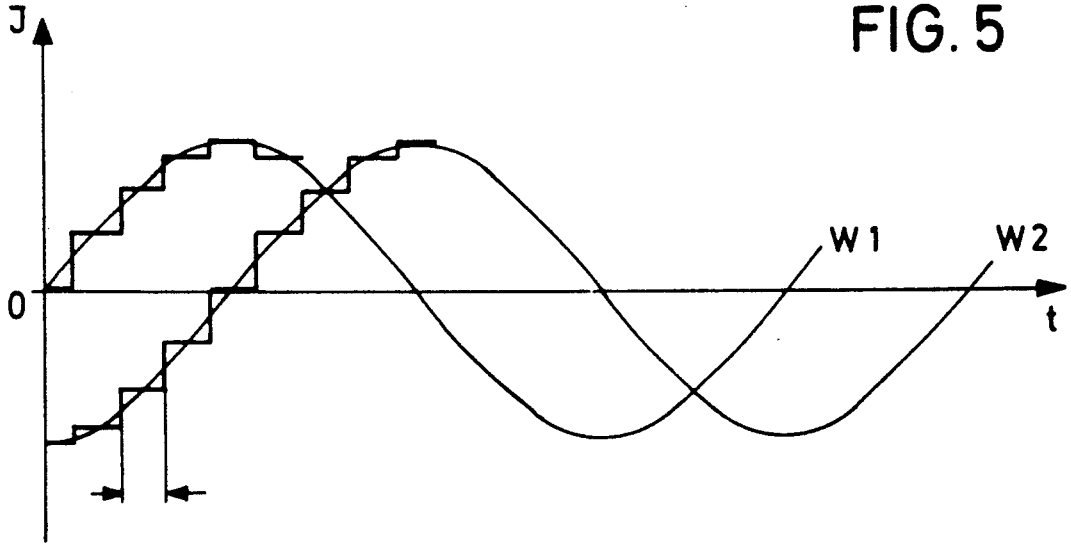
FIG. 5 shows the course of current in the windings $W_1$ and $W_2$ of FIG. 4.

FIG. 4 shows a block diagram of the micro-step control for the step motors. The microprocessor MP is connected with two digital-analog converters $D/A_1$, $D/A_2$ via data output line sets $L_1$ and $L_2$ which are assigned to the individual windings of the step motor $W_1$ and $W_2$. The output signals of the digital-analog converters $D/A_1$ and $D/A_2$ are fed to the windings $W_1$ and $W_2$ of the step motor SM or the motor M, respectively, via output stages $V_1$ and $V_2$. The microprocessor MP generates digital signals which correspond to the digitized sine curve according to FIG. 5. As can be seen from FIG. 5, the two windings $W_1$ and $W_2$ obtain a sine-shaped current which is displaced by 90°, but which is divided into individual steps. As shown by FIG. 5, each whole step of the motor SM is divided into eight digitalized step patterns, wherein the windings $W_1$ and $W_2$, in each instance, simultaneously have the corresponding current signals fed to them with the correct amplitude. For example, if a half wave is divided into eight micro-steps, then four micro-steps are to be covered between the zero point of the sine curve and the maximum, the four micro-steps being represented by means of corresponding digital signals of the microprocessor MP. For example, in the example shown in FIG. 5, the digital signal "4" was given out by the microprocessor MP for the winding $W_1$ in the initial stage, while the digital signal "0" was given out for the winding $W_2$. In the stepwise mode, the digital signals from the microprocessor to the lines $L_1$ and $L_2$ would then change in that the digital signal "5" would be given out for the winding $W_1$ and the digital signal "1" would be given out for the winding $W_2$ etc. until the two windings had run through a whole step.

Should the motor be stopped in a determined respective position, the winding current is preserved in the windings $W_1$ and $W_2$ so that the step motor is held in the corresponding position. In this way, it is possible, by means of the corresponding programming of the microprocessor MP, to effect the printing of the centrally arranged characters, for example 14 according to FIG. 2, in the correct flush right position in that a corresponding micro-step pattern of the two windings $W_1$ and $W_2$ is assigned to this printing type.

Figure 3:
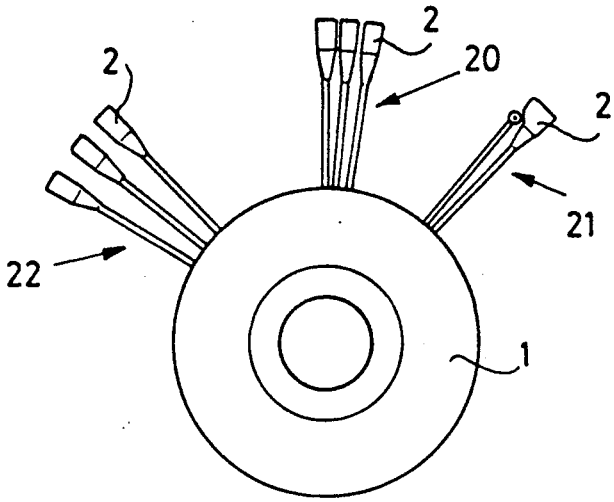
FIG. 3 is a spoke type wheel of particular construction.

But still another problem can be solved by means of applying the micro-step control in the sense of the invention: different kinds of script do not always have the same dimensioning, and the print pitches of the individual scripts need not necessarily be identical to one another. Here, as well, the micro-step control can be of valuable assistance, as will be made clear by means of a description according to FIG. 3. Three groups of type heads 2–20, 21 and 22–are shown. The pitch of the arrangement of the type heads 2 relative to one another is different in group 20 and group 22. For example, the ratio is 2:3. For printing two adjacent characters in an arrangement such as is provided in group 20, the type wheel 2 would have to execute, e.g., one macro-step or eight micro-steps, but in an arrangement of the type heads 2 as shown in group 22, 1.5 macro-steps or 12 micro-steps would have to be executed.

The type arrangement according to group 21 shows yet another possibility. Again, type having very different dimensionings must often be printed. In particular, a period requires very little space while alphabet character type or symbols require substantially more space. It is possible, through the use of micro-step control of the type wheel 1, to include type with different pitches on the same type wheel within a set of type. By means of the micro-step control, it is possible, at any time, to print such type in the correct printing positions.

Numerous alterations of the structure herein disclosed will suggest themselves to those skilled in the art. However, it is to be understood that the above embodiments are for purposes of illustration only and not to be construed as a limitation of the invention. All such modifications which do not depart from the spirit of the invention are intended to be included within the scope of the appended claims.

We claim:

1. A printing device for the production of automatically readable script on documents, including a spoke type wheel having characters respectively formed in printing ends of spokes thereof, a stop mechanism for the documents, a step motor, and means for micro-step control of said step motor, for the adjustment of said spoke type wheel in a desired printing position, characterized in that pitches between adjoining spokes of said type wheel differ, wherein said micro-step controlled step motor effects an adjustment of said type wheel in the desired printing position.

2. Printing device according to claim 1, characterized in that different type sets are arranged on spokes with different pitches with respect to the diameter of said wheel.

3. Printing device according to claim 1, characterized in that the pitch of said spoke type wheel is adapted to the characters to be printed.

4. A printing device for a production of automatically readable script on documents, including a spoke type wheel having asymmetrical characters respectively formed on printing ends of spokes thereof, a stop mechanism for said documents, a transporting mechanism, comprising a step motor and means for micro-step control of said step motor, for said document in order to produce character spacings, characterized in that the asymmetrical characters, which are to be printed in a defined area so as to be selectively flush left or flush right, are arranged centrally on the spokes of said spoke type wheel, and in that said documents, resting on a stop of said stop mechanism and being pressed against a printing base, is driven by said transporting means, further including feed rollers and/or a transporting belt, when printing does not occur, said documents being moved in micro-steps by different character spacings by means of said step motor driving the transporting mechanism, whereby said selective flush left or flush right printing is effected, respectively, despite the central arrangement of the type on said spokes.

* * * * *